United States Patent [19]

Mazzorana et al.

[11] Patent Number: 4,649,285

[45] Date of Patent: Mar. 10, 1987

[54] ELECTRIC STARTER INCORPORATING A BASE PLATE SUPPORTING THE CARCASE OF ITS ELECTRIC MOTOR AND THE YOKE OF ITS CONTACTOR

[75] Inventors: Alfred B. Mazzorana, Venissieux; Francis Froment, Lyons, both of France

[73] Assignee: Societe Paris-Rhone, Lyons, France

[21] Appl. No.: 696,481

[22] Filed: Nov. 7, 1984

[30] Foreign Application Priority Data

Nov. 30, 1983 [FR] France ..... 83 19369

[51] Int. Cl.[4] ..... F02N 11/08; H02P 9/04

[52] U.S. Cl. ..... 290/48; 310/83; 310/90

[58] Field of Search ..... 290/48; 123/179 R; 310/83, 90; 74/7 A

[56] References Cited

U.S. PATENT DOCUMENTS 3,209,603 10/1965 Rodriquez ..... 74/7 A
3,897,843 8/1975 Hapeman et al. ..... 310/83 X

FOREIGN PATENT DOCUMENTS 908508 3/1954 Fed. Rep. of Germany ..... 310/90
1354018 4/1963 France .
2410148 6/1979 France .
2120461 11/1983 United Kingdom ..... 74/7 A

*Primary Examiner*—L. T. Hix
*Assistant Examiner*—Brian W. Brown
*Attorney, Agent, or Firm*—Dowell & Dowell

[57] ABSTRACT

An electric starter comprising a base plate supporting the housing of its electric motor and the yoke of its contactor, wherein the base plate has a central bore in which is placed a bearing maintained in position by means of a disc of plastics material moulded over the plate and which further constitutes the outer ring gear of an epicycloidal reduction gear placed between the electric motor and the shaft of the starter actuator. The disc may further include a lateral lug constituting support for the pin of the actuator lever. A flange made around the ring may form a seal between the housing of the electric motor and the base plate. The invention is more particularly applicable to electric starters for internal combustion engines.

8 Claims, 2 Drawing Figures

ELECTRIC STARTER INCORPORATING A BASE PLATE SUPPORTING THE CARCASE OF ITS ELECTRIC MOTOR AND THE YOKE OF ITS CONTACTOR

The present invention relates to electric starters for internal combustion engines comprising an actuator controlled by a lever which is pivoted by means of a solenoid contactor parallel to the electric motor of said starter whose housing is mounted on a base plate which also supports the yoke of the contactor.

French Patent No. 1 354 018, presently expired, discloses an electric starter for internal combustion engine wherein the housing of the electric motor is supported by a base plate on which the nose of the starter is mounted.

In Applicants' French Patent No. 2,410,148, such a plate further supports the contactor adapted to control the pivoting of the actuating lever. In this Patent, the base plate constitutes a means for centering the shaft of the electric motor so that, at rest, the vibrations of the latter are very largely reduced.

According to the invention, the base plate supports a bearing in which rotates the satellite ring of an epicycloidal reduction gear of which the input shaft is that of the armature. The bearing in question is maintained in position by means of a disc made of plastics material moulded over the base plate. The disc in question is advantageously extended by a tubular fixed ring oriented in the direction of the armature of the electric motor. The fixed ring's inner face is provided with a toothing adapted to constitute the front ring of the epicycloidal reduction gear mentioned above.

Due to the relatively easy production of a mould for injection of plastics material, the bearing, which is made in the form of an annular bushing, may be placed so that its concentricity with the fixed ring gear is precise. Alternatively a housing for supporting a bushing perfectly concentric with the fixed ring gear may similarly be obtained.

Moreover, it is sure that the toothing of the latter is perfectly perpendicular to the base plate.

Whether the bushing is mounted with or without clearance in the base plate, the epicycloidal reduction gear as well as the general assembly of the starter are thus considerably simplified.

The presence of the plastic disc may allow the formation of a lateral tab constituting support for the pivot pin of the actuator lever.

Finally, part of the overmoulded disc may be used for forming a seal between the housing of the electric motor and the base plate.

The invention will be more readily understood on reading the following description with reference to the accompanying drawings, in which.

Figure 1:
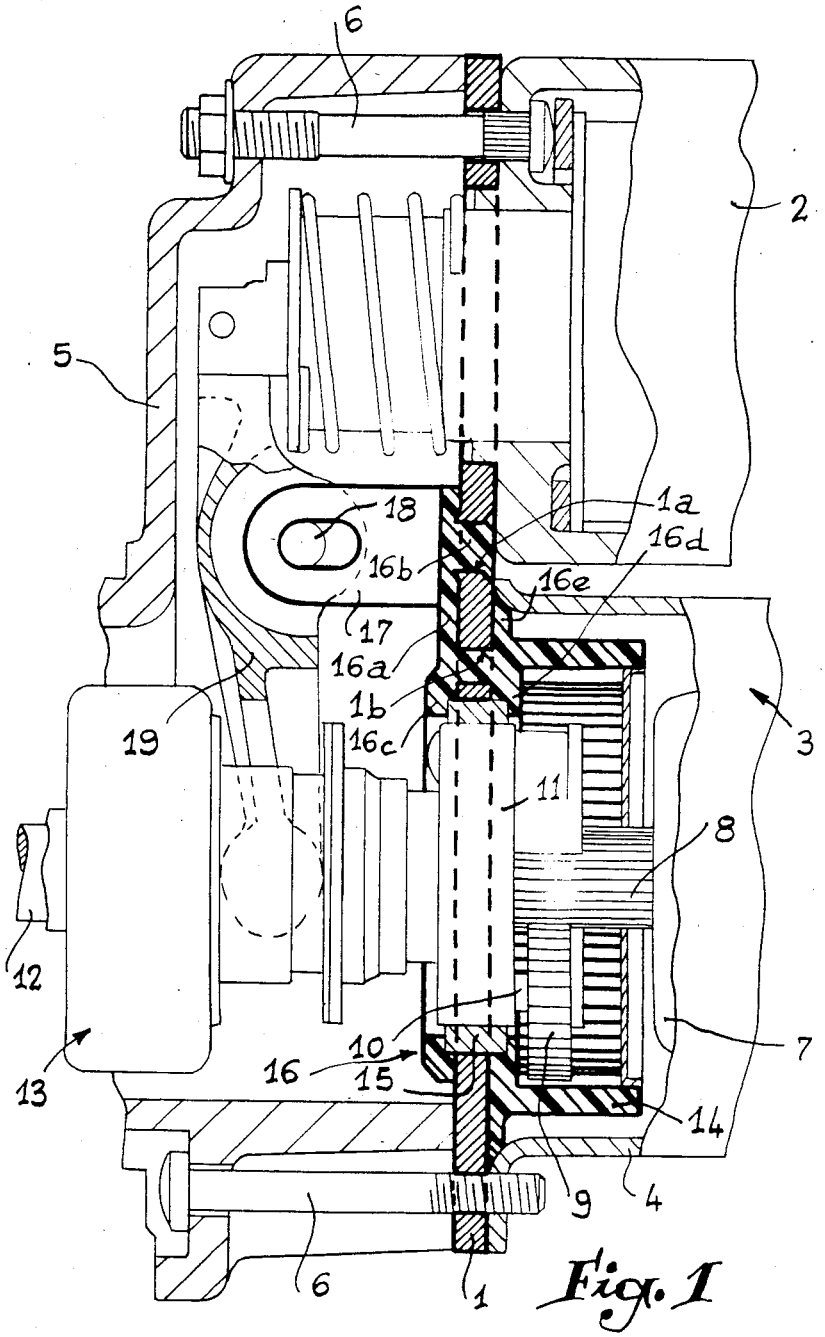
FIG. 1 is a partial longitudinal section of an electric starter incorporating the improvements according to the invention.

Referring now to the drawing, a base plate 1 made of sheet metal constitutes the support for the contactor 2 of the starter and for its electric motor 3 and more particularly for the housing 4 thereof. This base plate is assembled on the nose 5 of the starter by means of tie-rods 6.

Said starter is of the type having a reduction gear, i.e. the shaft of the armature 7 of the electric motor bears a central pinion 8 meshing with satellite gears 9 conventionally mounted on pins 10 fixed to a satellite-ring 11 which constitutes the output shaft of the reduction gear, so that it is fixed to a secondary shaft 12 adapted to drive the actuator of the starter, referenced 13, in rotation. Of course, the satellite gears roll with respect to an internally toothed fixed ring 14 as is well known in the art.

According to the invention, the satellite-ring 11 rotates with guidance by a bearing made in the form of a sintered bushing 15 supported by the base plate 1. This bushing may be forced-fitted in a central bore in the plate or may be maintained with respect to this bore by a plastic disc 16 moulded over the base plate and said bushing. In the event of the latter being force-fitted in the central bore of the base plate, the disc 16 comprises two annular cheeks **16*c*, 16*d* which maintain the two faces of the bushing 15** laterally so that it cannot move parallel to the axis of the electric motor.

In the other case, the bushing 15 is placed with clearance in the central bore of the base plate, so that the disc 16 then centers the bushing with respect to the plate, in addition to its role of lateral hold.

Figure 2:
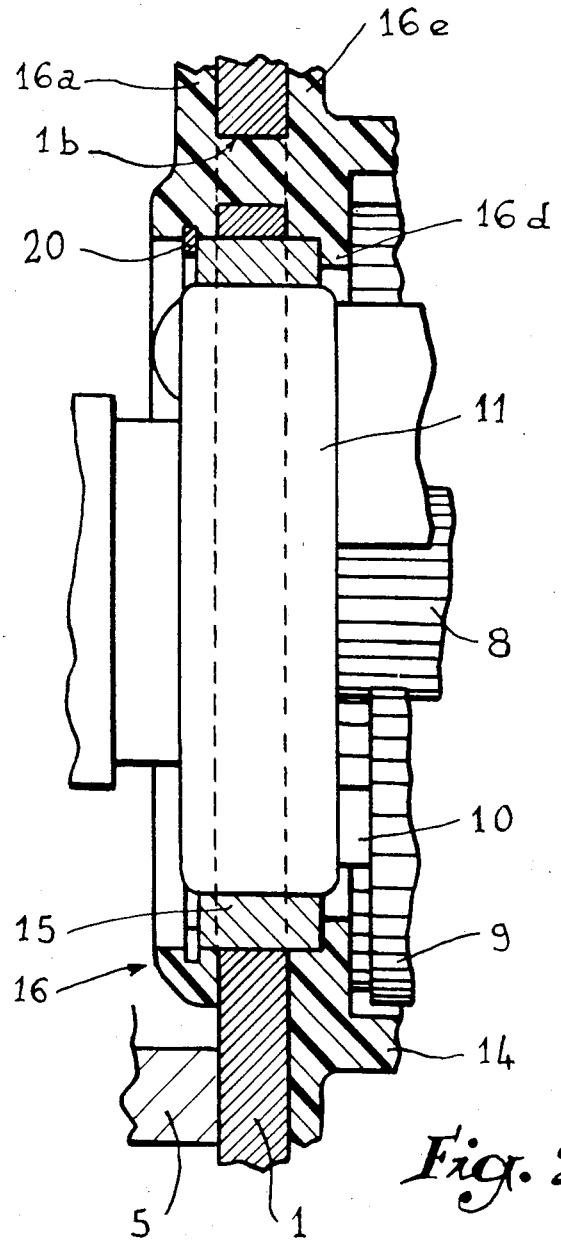
FIG. 2 is a partial view on a larger scale of a modified embodiment.

The bearing may also be fitted after overmoulding. In that case, a lateral hold such as **16*c* or 16*d* will be eliminated. This type of assembly is necessary if the bearing cannot support overmoulding: i.e. in the case of a bushing made of impregnated sintered material or in the case of a roller bearing. It is also possible to envisage an overmoulding at the centre of the disc 16 which would define a central housing in which the bushing 15 would be fitted. In that case, one of the cheeks 16*c* or 16*d* would obviously be eliminated and possibly replaced by any stop system 20, FIG. 2. This solution would be employed if the bushing 15** could not withstand the rise in temperature due to overmoulding, for example if this bush is made of impregnated sintered material or if the bush is replaced by a roller bearing.

It is advantageous to extend the disc 16 so that it also constitutes the internally-toothed ring 14 which, under these conditions, is automatically centred precisely with respect to the bore of the bush 15, so that, since the satellite ring is perfectly concentric to the toothing of the ring 14, the latter and the satellite gears are quite precisely in mesh. Moreover, as has been indicated above, the toothing of the ring 14 may be easily made so that it is oriented with precision perpendicularly to the base plate 1.

The presence of the disc 16 may be profitably employed to form on its periphery a lug **16*a* located on the face of the base plate 1 turned to extend towards the actuator 13, said lug constituting the base of a tab 17 perpendicular to the base plate and supporting the pin 18 of the lever 19 actuating the actuator 13. It will be observed that the lug 16*a* is anchored in the plate 1 by means of an extension 16*b* of the disc 16 penetrating in a widened perforation 1*a* in the base plate. Similarly, openings 1*b* are provided about the central bore of the base plate 1 so that the two cheeks 16*c*, 16*d* of the disc 16 disposed on either side of the bush 15 and consequently located on the two faces of the plate 1**, are perfectly connected.

The cheek **16*d* of the disc 16 may be shaped so as to constitute a seal between the housing 4 of the electric motor 3 and the base plate. Reference 16*e* designates the flange surrounding the ring 14** to this end.

A structure has thus been produced which considerably simplifies the construction of the epicycloidal reduction gear whilst facilitating the general assembly of the starter.

It must, moreover, be understood that the foregoing description has been given only by way of example and that it in no way limits the domain of the invention which would not be exceeded by replacing the details of execution described by any other equivalents.

What is claimed is:

1. An improved electric starter for an internal combustion engine wherein the starter includes an electric motor having a housing and having a motor shaft, and includes an actuator supported on a secondary shaft, and includes an electrical contactor coupled by a lever to the actuator and operative when energized to displace the actuator on the secondary shaft to engage the starter, the improvements comprising:

(a) a base plate supporting the motor housing and the contactor, the base plate having a central bore aligned with the motor shaft;

(b) an epicycloidal reduction gear extending through said central bore and having a central pinion secured to the motor shaft, and having a satellite ring supported for rotation in bearing means and connected with said secondary shaft and the satellite ring supporting satellite gears meshing with said pinion, and having an internally-toothed fixed ring meshing with said satellite gears; and (c) a plastic disc fixed to said base plate and extending through its central bore and supporting said bearing means aligned with the motor shaft, and the plastic disc carrying said internally-toothed ring aligned with said motor shaft and said bearing means.

2. The starter as claimed in claim 1, wherein said plastic disc is moulded to the plate about its central bore, and said internally-toothed fixed ring is integral with the plastic disc.

3. The starter as claimed in claim 1, wherein said bearing means comprises a bushing which is force-fitted into said central bore and retained therein by said plastic disc.

4. The starter as claimed in claim 1, wherein said plastic disc includes annular cheek means maintaining the bearing means aligned with the motor shaft.

5. The starter as claimed in claim 1, wherein said plastic disc includes a central housing for receiving and supporting said bearing means.

6. The starter as claimed in claim 5, wherein said central housing has an annular cheek against which the bearing means abuts; and stop means in the housing retaining the bearing means against the annular cheek.

7. The starter as claimed in claim 1, wherein said plastic disc further includes a tab extending from the base plate; and a pin transfixing the tab and pivotally supporting the lever between the contactor and the actuator.

8. The starter as claimed in claim 1, wherein said plastic disc includes an annular flange surrounding the central bore of the plate in contact with the motor housing and forming a seal therewith.

* * * * *